US009959691B2

(12) United States Patent
Cumbo et al.

(10) Patent No.: US 9,959,691 B2
(45) **Date of Patent: *May 1, 2018**

(54) ELECTRONIC LATCH RELEASE BACKUP SYSTEM FOR A MOTOR VEHICLE DOOR

(71) Applicant: Magna Closures S.p.A., Guasticce (Leghorn) (IT)

(72) Inventors: Francesco Cumbo, Pisa (IT); Marlia Marco, Pisa (IT); Santaniello Liberatore, Lucca (IT)

(73) Assignee: MAGNA CLOSURES S.p.A., Guasticce (Leghorn) (IT)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/608,034

(22) Filed: May 30, 2017

(65) Prior Publication Data

US 2017/0263064 A1 Sep. 14, 2017

Related U.S. Application Data

(63) Continuation of application No. 14/975,903, filed on Dec. 21, 2015, now Pat. No. 9,666,004.

(51) Int. Cl.
*G07C 9/00* (2006.01)
*E05B 81/08* (2014.01)
(Continued)

(52) U.S. Cl.
CPC ..... *G07C 9/00174* (2013.01); *E05B 47/0611* (2013.01); *E05B 81/08* (2013.01);
(Continued)

(58) Field of Classification Search
CPC ..... G07C 9/00174; G07C 2009/00761; E05B 47/0611; E05B 81/08; E05B 81/46;
(Continued)

(56) References Cited

U.S. PATENT DOCUMENTS 9,666,004 B2 * 5/2017 Cumbo ..... G07C 9/00174
2010/0237635 A1 9/2010 Ieda et al.
2012/0139269 A1 6/2012 Kouzuma

FOREIGN PATENT DOCUMENTS

DE 10029008 A1 12/2000
DE 10109827 A1 9/2002
(Continued)

OTHER PUBLICATIONS

Search Report for Italian Patent Application No. TO20141102 dated t dated Aug. 14, 2015 with English translation.

*Primary Examiner* — Ali Neyzari
(74) *Attorney, Agent, or Firm* — Dickinson Wright PLLC

(57) ABSTRACT

A latch release backup system for a latch assembly of a motor-vehicle door is provided with a key cylinder configured to receive a vehicle key and which is rotatably mounted to the motor-vehicle door, and a mechanical coupling arrangement mounted within the motor-vehicle door and operable to convert a rotation of the key cylinder into actuation of an actuation group of the latch assembly for causing latch release. The key cylinder defines an electrical interface socket designed to receive the vehicle key. An electronic control unit is mounted within the motor-vehicle door and is electrically connected to the electrical interface socket to receive identification information (Id) from the vehicle key when plugged into the electrical interface socket. The mechanical coupling arrangement is normally disengaged from the actuation group of the latch assembly, and the electronic control unit is configured to control selective engagement of the mechanical coupling arrangement to the actuation group of the latch assembly based on the identification information (Id) received from the vehicle key.

20 Claims, 4 Drawing Sheets

(51) Int. Cl.

| | |
|---|---|
| ***E05B 81/56*** | (2014.01) |
| ***E05B 81/72*** | (2014.01) |
| ***E05B 83/28*** | (2014.01) |
| ***E05B 83/18*** | (2014.01) |
| ***E05B 83/24*** | (2014.01) |
| ***E05B 47/06*** | (2006.01) |
| ***E05B 81/90*** | (2014.01) |
| ***E05B 85/06*** | (2014.01) |
| ***E05B 81/46*** | (2014.01) |

(52) U.S. Cl.
CPC ..... *E05B 81/46* (2013.01); *E05B 81/56* (2013.01); *E05B 81/72* (2013.01); *E05B 81/90* (2013.01); *E05B 83/18* (2013.01); *E05B 83/24* (2013.01); *E05B 83/28* (2013.01); *E05B 85/06* (2013.01); *G07C 2009/00761* (2013.01)

(58) Field of Classification Search
CPC ..... E05B 81/56; E05B 81/72; E05B 81/90; E05B 83/18; E05B 83/24; E05B 83/28; E05B 85/06
USPC ..... 340/5.72
See application file for complete search history.

(56) References Cited

FOREIGN PATENT DOCUMENTS

| | | | |
|---|---|---|---|
| DE | 102004039187 | A1 | 2/2006 |
| DE | 102006002119 | A1 | 7/2006 |
| EP | 1564689 | A2 | 8/2005 |
| EP | 2463462 | A1 | 6/2012 |

* cited by examiner

ELECTRONIC LATCH RELEASE BACKUP SYSTEM FOR A MOTOR VEHICLE DOOR

CROSS-REFERENCE TO RELATED APPLICATIONS

This application is a continuation of U.S. application Ser. No. 14/975,903 filed Dec. 21, 2015, now U.S. Pat. No. 9,666,004, and which claims the benefit and priority of Italian Patent Application No. TO2014A001102 filed Dec. 24, 2014. The entire disclosure of the above application is incorporated herein by reference.

FIELD

The present disclosure relates generally to a latch release (or unlock) backup system associated with a latch assembly of a motor vehicle door closure system. More particularly, the present disclosure relates to such a latch release backup system having an electronic key and electronic key cylinder arrangement operable to selectively control operation of a release actuator associated with the latch assembly.

BACKGROUND

This section provides background information related to the present disclosure and which is not necessarily prior art.

In the following description and the accompanying claims, the expression "door" will be used to generally indicate any element movable between an open position and a closed position, respectively opening and closing an access to an inner compartment of a motor vehicle, and therefore including boot, rear hatches, liftgates, bonnet lid or other closed compartments, in addition to the side doors of the motor vehicle, to which the following description will make explicit reference.

As it is known, door latches are provided in motor vehicles for controlling opening and closing of the side doors (driver and passenger doors, and rear doors if present). Such a door latch generally includes a latch mechanism having a ratchet that is selectively rotatable with respect to a striker fixed to a door post in order to latch and unlatch the door. The ratchet is typically moveable between a striker capture position whereat the door is latched and a striker release position whereat the door is unlatched. The latch mechanism also typically includes a pawl that is operable in an engaged or ratchet holding position to engage the ratchet and prevent the ratchet from rotating out of its striker capture position.

In traditional arrangements, the pawl is moved from its engaged position to a non-engaged or ratchet releasing position which, in turn, permits the ratchet to rotate to its striker release position. Typically, the pawl is moved to its non-engaged position via a manual actuation of a mechanical element such as, for example, a release lever that is mechanically interconnected via a linkage mechanism to a door handle. Electrical door latches may instead include an electric motor, which is electrically connected to a main electric power supply of the vehicle (e.g. to the 12 V battery of the same vehicle), in order to directly or indirectly drive the pawl to its non-engaged position via an electrically-operated actuator (e.g. including a release lever) so as to release or unlock the latch after receiving a user command issued, for example, via a remote electronic key.

Number 1 in FIG. 1 indicates, as a whole, an electrical latch assembly 1 that is coupled to a side door 2 of a motor vehicle 3.

Electrical latch assembly 1 is electrically connected to a main power source 4 of motor vehicle 3 (i.e. a main battery providing a battery voltage Vbatt of 12 V) through an electrical connection element 5 (i.e. a power cable). Alternatively, main power source 4 may equally include a different source of electrical energy within motor vehicle 3 such as, for example, an alternator.

Electrical latch assembly 1 includes an actuation group 6' including in this case an electric motor 9 operable to control latching and unlatching of side door 2. In a possible embodiment, actuation group 6' also includes a latch mechanism having a ratchet 6 and a pawl 8. Ratchet 6 is selectively rotatable to engage a striker 7 that is fixed to the body of motor vehicle 3 (e.g. to the so called "A pillar" or "B pillar") in a manner not shown in detail. When ratchet 6 is rotated into a latching or striker capture position with respect to striker 7, side door 2 is in a closed (i.e. latched) operating state. Pawl 8 selectively engages ratchet 7 in an engaged or ratchet holding position to prevent it from rotating out of the striker capture position. Paul 8 is moveable between the engaged position and a non-engaged or ratchet releasing position for permitting ratchet 6 to move from its latching position into an unlatching or striker release position. When ratchet 6 is located in its unlatching position relative to striker 7, side door 2 is in an opened (i.e. unlatched) operating state.

In some solutions, electrical latch assembly 1 may further include an electronic control circuit 10 (e.g. including a microcontroller or other known computing unit) which may be conveniently integrated and arranged in a common housing or case 11 (shown schematically) with actuation group 6', thus providing a compact and easy-to-assemble unit.

Electronic control circuit 10 is in this case coupled to the electric motor 9 and provides driving signals Sd thereto in order to control latch operation. Electronic control circuit 10 is electrically coupled via a data bus 14 to a vehicle main management unit (also known as main ECU or "vehicle body computer") 12 which is configured to control general operation of motor vehicle 3 so as to exchange signals, data, commands and/or information.

Electronic control circuit 10 is also coupled to main power source 4 of motor vehicle 3 so as to receive the battery voltage Vbatt, and may also include an embedded and integrated backup energy source (here not shown) which is configured to supply electrical energy to actuation group 6' and electric motor 9, as well as to electronic control circuit 10, in case of failure or interruption of the main power supply from main power source 4 of motor vehicle 3.

It is known that security regulations require the possibility of controlling opening and closing of the doors even in case of failure or discharge of the main power supply of the vehicle, in case of interruptions or breaking of the electrical connection between the main power supply and the electric motor in the latch, or in case of malfunctions of the same electric motor. In other words, a latch release backup system must be provided.

Known release backup systems typically include a mechanical key cylinder 15 housed in vehicle door 2 and configured to receive a mechanical key of the vehicle for releasing or unlocking the latch mechanism, namely for moving pawl 8 to its non-engaged position via a mechanical connection element 16 (in a known manner, here not discussed in detail). This mechanical key and key cylinder arrangement operates as a manual backup to the electrically-activated door latch mechanism. As is conventional, key cylinder 15 is mechanically paired to the vehicle key and carries a suitable mechanical code to match with the key and interact therewith (in a known manner, here not discussed in detail).

However, the presence of this mechanical arrangement entails a high area occupation and weight and additional costs, and also represents a constraint for designing the vehicle door in terms of door style design, or standardization of door and handles between passenger and driver sides or among different vehicles. Moreover, the presence of mechanical key cylinder 15 entails possible security issues, since it may not be difficult for a thief to exploit and gain access to the related mechanism in order to access the vehicle. Suitable anti-theft devices have therefore to be envisaged, again with consequences on the complexity and overall costs of the system.

A need is therefore felt for an improved latch release backup system for a motor vehicle latch.

SUMMARY

This section provides a general summary of the disclosure, and is not a comprehensive disclosure of its full scope or all of its features.

It is an object of certain aspects of the present disclosure to provide an improved latch release backup system that is designed to meet the aforementioned need.

This object can be achieved by providing a latch release backup system for use in association with a latch assembly of a motor vehicle door closure system. The latch release backup system of the present disclosure comprises: an electronic key cylinder having an electrical interface socket configured to receive an electronic vehicle key and which is rotatably mounted to the motor-vehicle door; a mechanical coupling arrangement mounted within the motor-vehicle door and operable to selectively convert a rotation of the electronic key cylinder into actuation of an actuation group of the latch assembly, thereby causing latch release; and an electronic control unit electrically connected to the electrical interface socket to receive identification information (Id) from the electronic vehicle key when it is plugged into the electrical interface socket. The mechanical coupling arrangement is normally disconnected from the actuation group of the latch assembly and the electronic control unit is configured to control selective actuation of a power-operated coupling device for connecting the mechanical coupling arrangement to the actuation group of the latch assembly based on authentication of the identification information (Id) received from the electronic vehicle key.

Further areas of applicability will become apparent from the description provided herein. The description and specific examples in this summary are intended for purposes of illustration only and are not intended to limit the scope of the present disclosure

DRAWINGS

A preferred, non-limiting embodiment of certain aspects of the present invention will be described by way of example with reference to the accompanying drawings, in which:

FIG. 1 is a schematic representation of a motor vehicle equipped with a conventional door latch system;

FIGS. 2*a*-2*c* show schematic representations of a vehicle door with a latch release backup system and an electronic key and key cylinder arrangement which are collectively constructed according to aspects of the present disclosure;

Corresponding reference numerals indicate corresponding components throughout the several views of the drawings.

DETAILED DESCRIPTION

Example embodiments will now be described more fully with references to the accompanying drawings. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
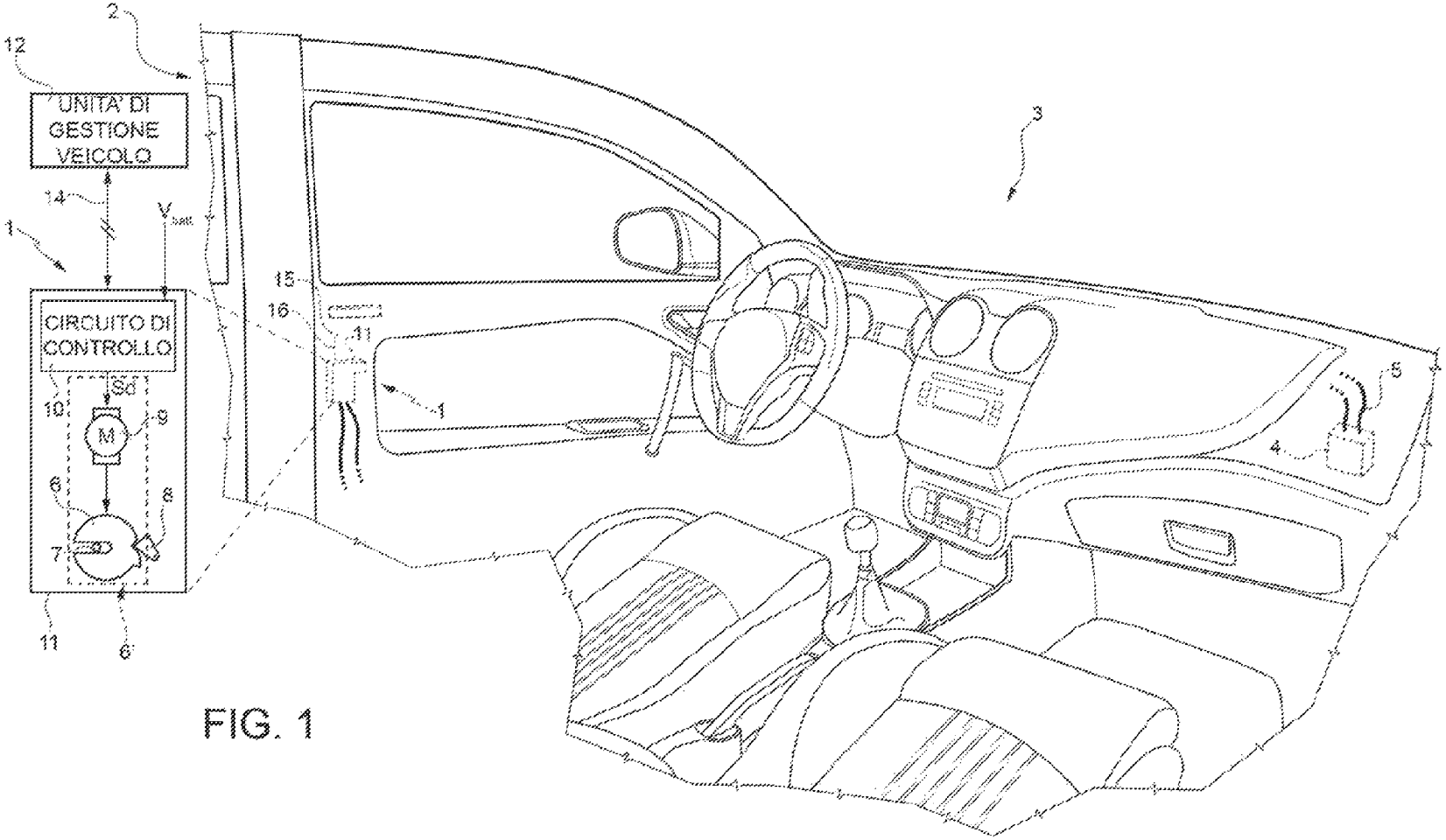
Figure 2A:
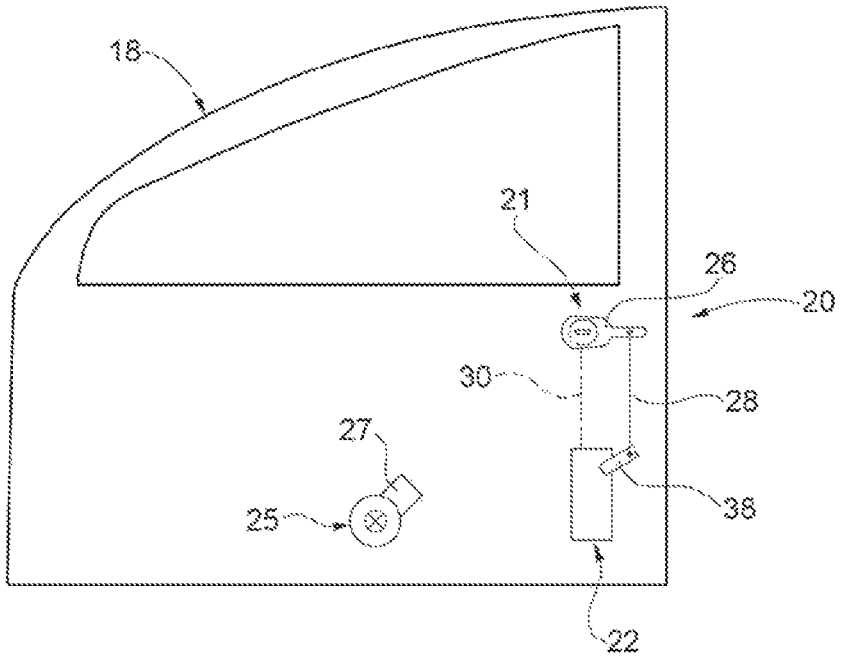
Figure 2B:
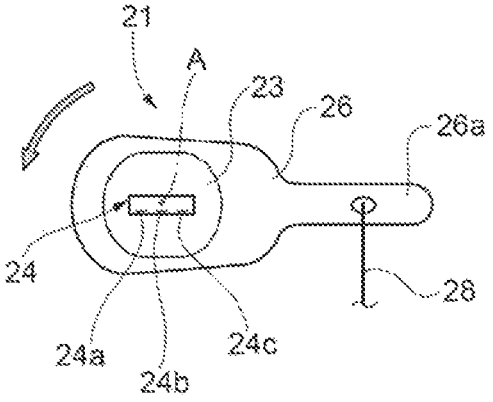
Figure 2C:
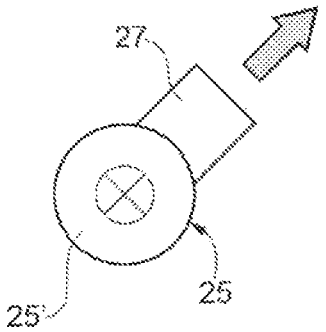

FIGS. 2*a*-2*c* schematically show a motor-vehicle door 18 provided with a latch release (or unlock) backup system 20 according to the present disclosure and including a key cylinder 21 and a latch assembly 22 operatively coupled thereto. It will be understood that operation of latch assembly 22 will be herein discussed only in relation to key cylinder 21 and the latch release backup functions. Accordingly, other aspects and functions of the latch assembly 22 which may not differ from known solutions (i.e. such as discussed with reference to FIG. 1) are not discussed in detail herein.

According to an aspect of the present disclosure, key cylinder 21 is "electronic" (and is thus denoted hereinafter as "electronic key cylinder 21") in that it no longer has any mechanical code or mechanical antitheft feature. Electronic key cylinder 21 includes a cylindrical main body 23, e.g. made of plastic material, which is mounted to vehicle door 18 for rotation relative to a rotary axis "A." Main body 23 of electronic key cylinder 21 defines an electrical interface socket or receptacle 24 configured for electrical connection to a vehicle key 25. Vehicle key 25 is also "electronic" since it no longer has any mechanical code or mechanical antitheft feature. Thus, the combination of electronic key cylinder 21 and electronic vehicle key 25 defines an "electronic key and key cylinder" arrangement.

Main body 23 defines both the electrical interface and a related case, mechanically matching the same electrical interface. To this end, electrical interface socket 24 is designed to implement any suitable electrical interface, preferably a standard electrical interface such as the USB (Universal Serial Bus) interface (either in the standard, mini or micro version), as illustrated in the example shown in FIG. 2*b*. However, it is understood that other types of electrical interfaces, either standard (e.g. a standard low voltage DC power supply plug or socket, a PS/2 interface or a HDMI interface) or application-specific, are within the intended scope of the present disclosure.

Moreover, electrical interface socket 24 may have a standard pinout or a specific, proprietary, pinout. According to one non-limiting embodiment, electrical interface socket 24 includes a power supply pin 24*a* designed to receive a power supply signal Vs, a ground reference pin 24*b* designed to be coupled to a reference voltage GND (e.g. a ground reference), and a data pin 24*c* designed to receive a data signal Sd. In another non-limiting solution, just two pins may be used if the power supply is also used to transmit the coded data signal Sd in a manner similar to a power-line.

Electronic vehicle key 25 is designed to plug into electrical interface socket 24 and to electrically interface therewith. Vehicle key 25 includes a respective main body 25' having a circular or elliptical cross section, as shown in FIG. 2*c*, which carries an electrical interface plug 27 that is configured to engage electrical interface socket 24. Electrical interface plug 27 implements the same standard electrical interface as the electrical interface socket 24, in the particular example, the USB standard electrical interface. Moreover, electrical interface plug 27 has a corresponding pinout and therefore includes (not shown in detail in FIG. 2*c*) a respective power supply pin, a ground reference pin, and a data pin. Again, only two pins may be used in another possible embodiment.

Figure 4:
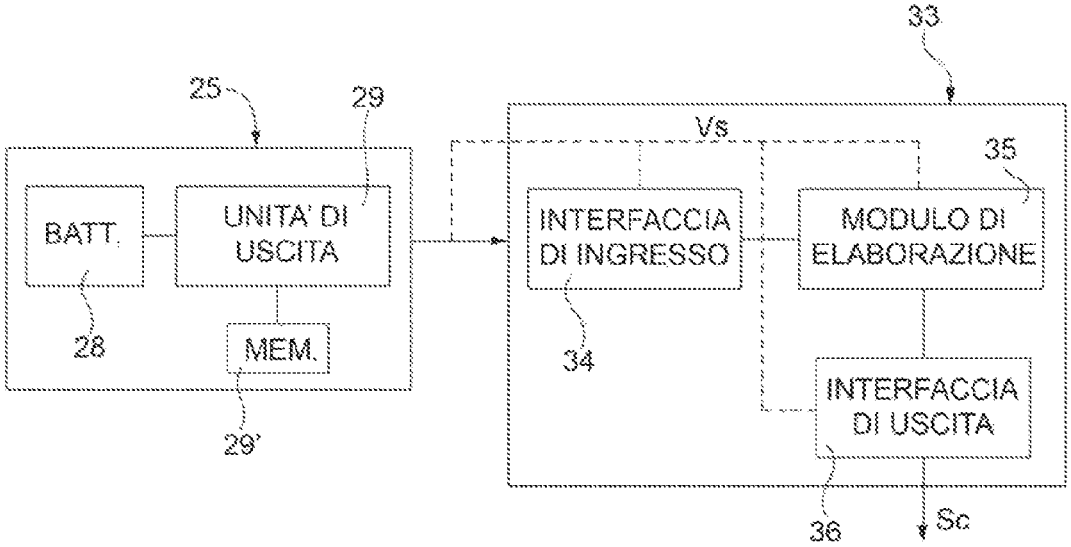
FIG. 4 is a general block diagram of the electronic key and a control unit associated with the latch assembly associated with the latch release backup system of the present disclosure.

As is also schematically shown in FIG. 4, vehicle key 25 includes a case which houses a power supply module (e.g. a battery) and an output interface module 29 that is coupled to a memory 29' (e.g. a non-volatile memory). In a possible embodiment, memory 29' stores a key identification and authorization code Id (or, in general, any identification information associated thereto and/or indicative of the same code), and output interface module is operable to transmit, through the data pin of electrical interface plug 27, the identification and authorization code Id to electronic key cylinder 21 (or any information associated thereto). Such transmission may be initiated by a user (e.g. pressing a button on the case 25') or may be started automatically when electronic vehicle key 25 is inserted into electronic key cylinder 21. Output interface module 29 is further operable to provide power supply to electronic key cylinder 21 and, in particular, the power supply signal Vs and the reference voltage GND.

Electronic key cylinder 21 further includes (FIGS. 2*a* and 2*b*) a movable arm 26 that is fixed to or integrally formed with main body 23 for common rotation around the longitudinal axis A of cylindrical main body 23. Movable arm 26 carries, at an end portion 26*a* thereof and at a set distance from the longitudinal axis A, a first end of a connecting element 28 which in this non-limiting example can be in the form of a Bowden cable or a rod. A second end of connecting element 28 is mechanically coupled to a moveable actuator element, preferably positioned outside of latch assembly 22 (as will be detailed in the following). As such, the moveable actuator element is coupled for common movement with moveable arm 26 of electronic key cylinder 21.

As will also be discussed in detail in the following, a mechanical connection between the moveable actuator element (coupled to moveable arm 26 of electronic key cylinder 21) and a moveable latch release element of the latch mechanism within latch assembly 22 (i.e. a release lever acting on pawl 8), is normally disengaged but can selectively and temporarily engage in response to actuation of a power-operated actuation unit. In particular, this mechanical connection is normally operable in a disengaged or first operating condition to define a "disconnected" mode such that movement of the actuator element caused by rotation of electronic key cylinder 21 and movable arm 26 does not cause any action within latch assembly 22, namely such movement of the actuator element does not result in the release or unlocking of the latch mechanism. In a possible embodiment, rotation of electronic key cylinder 21 may be a free 360° rotation around its longitudinal axis A caused by a corresponding rotation of any suitable element inserted into electronic key cylinder 21 and having the proper electrical interface.

In contrast, once the mechanical connection is shifted into an engaged or second operating condition defining a "connected" mode, movable arm 26 and the actuator element are mechanically connected to the release mechanism or to the unlocking chain of the latch mechanism (e.g. to the release lever within latch assembly 22) such that rotation of electronic key cylinder 21 (caused by a corresponding rotation of vehicle key 25 inserted within the same electronic key cylinder 21) causes unlocking or release of the latch mechanism and allows opening of vehicle door 18 (for example, rotation of movable arm 26 is translated into a rotation of the release lever within latch assembly 22).

In the discussed embodiment, the mechanical connection between movable arm 26 of electronic key cylinder 21 and the moveable actuator element of latch assembly 22 is always maintained, both in the first and in the second operating conditions.

Electronic key cylinder 21 is also electrically connected to latch assembly 22 in order to communicate the identification and authorization code Id received from vehicle key 25 (or any information associated thereto and/or indicative of the same code) and also to provide the power supply. An electrical cable 30, carrying the above power supply signal Vs, ground reference GND and data signal Sd, connects electronic key cylinder 21 to latch assembly 22. As previously discussed, electrical cable 30 could optionally provide only the power supply signal Vs and not the data signal Sd, in case the same power supply signal Vs where used to transmit the code or the information associated thereto.

In particular, engagement of the above mechanical connection between movable arm 26 of electronic key cylinder and the release element of the latch mechanism is based on processing of the identification and authorization code Id received from vehicle key 25 (or of any information associated thereto).

Figure 3:
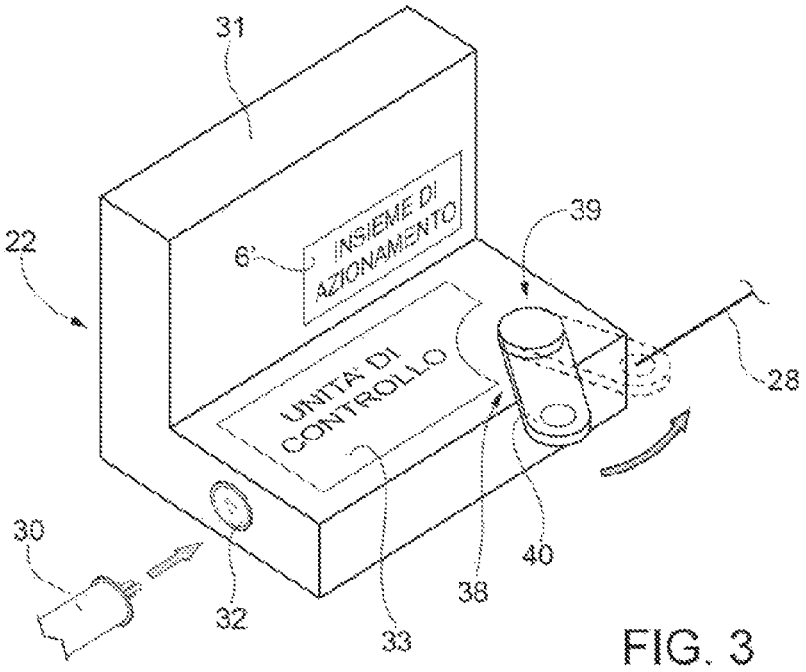
FIG. 3 is a schematic representation of a latch assembly associated with the latch release backup system of the present disclosure.

In more details, as schematically shown in FIG. 3 and according to an aspect of the present solution, latch assembly 22 includes a case 31 which carries on an external surface thereof an electrical connector 32 configured for connection to electrical cable 30 so as to receive the power supply signal Vs, ground reference GND and data signal Sd from electronic key cylinder 21 (or just the power supply signal Vs, and possibly the ground reference GND, in a different embodiment).

In a manner not shown in detail, case 31 internally houses actuation group 6' of latch assembly 22 and, in particular, the ratchet and pawl of the latch mechanism (as previously discussed in more details with reference to FIG. 1). Actuation group is schematically shown and again denoted with reference numeral 6'.

Latch assembly 22 further includes a control unit 33 which, in this non-limiting embodiment, is housed within case 31 and is coupled to electrical connector 32. Control unit 33 may also have other functions within latch assembly 22. As schematically shown in FIG. 4, control unit 33 may include an input interface 34 electrically coupled to electrical connector 32 and electrical cable 30, a processing module 35 electrically coupled to input interface 34, and an output interface 36 electrically coupled to processing module 35 and configured to generate and provide at its output an actuation control signal Sc. In particular, input interface 34, processing module 35, and output interface 36 are electrically powered by the power supply signal Vs received from electronic key cylinder 21.

Processing module 35 of control unit 33 includes a microprocessor, a microcontroller or any other suitable processing module, and a non volatile memory storing a firmware including instructions to be performed by control unit 33. Processing module 35 is configured to process the received identification and authorization code Id (or any information associated thereto and/or indicative of the same code) by comparing it to a code stored in the associated memory (or to any information related to the same code), in order to recognize and authorize vehicle key introduced within electronic key cylinder 21. In particular, it is understood that any other known technique for code recognition, e.g. those commonly used for vehicle keys, may be used for the above authentication process; for example any processing technique to evaluate matching of the codes or correspondence of information associated thereto, for example via a function or other features known to control unit 33. In a possible embodiment, communication between vehicle key 25 and control unit 33 may also be of a bi-directional type.

As shown in FIG. 3, latch assembly 22 further includes a power-operated actuation unit 38 having a main body 39 pivotably mounted to case 31. As will be detailed, a segment of main body 39 acts as the moveable actuator element to which the second end of connecting element 28 is secured. In particular, and as better shown in FIGS. 5*a* and 5*b*, main body 39 has a first body portion 39*a* arranged outside of case 31, and a second body portion 39*b* arranged within the same case 31 (and therefore not accessible from outside of case 31). Main body 39 is, in this non-limiting embodiment, rotatably mounted to case 31 so as to rotate around a longitudinal axis B. First body portion 39*a* of main body 39 of actuator unit 38 moreover carries, integral thereto, the actuator element, hereinafter referred to as an external lever 40, which extends transverse to the longitudinal axis B. A distal end of lever 40, set at a distance from the longitudinal axis B, is coupled to the second end of connecting element 28.

Accordingly, concurrent rotation of electronic key cylinder 21 (e.g. counter clock-wise) and movable arm causes a corresponding rotation (e.g. also counter clock-wise) of external lever 40 outside of case 31 of latch assembly 22 (this mechanical coupling being present in both the engaged and the disengaged operating conditions).

In particular, when actuator unit 38 is operating in the disconnected mode, rotation of external lever 40 is normally in a free-wheeling or disengaged condition such that it is not coupled to the actuation group 6' and does not cause any action within latch assembly 22. Once actuation unit 38 is shifted into the connected mode, however, external lever 40 is coupled to the actuation group 6' and its rotation causes unlocking or release of the latch (e.g. rotation of external lever 40 in the engaged condition directly or indirectly causes pawl 8 to disengage ratchet 7 within actuation group 6').

Figure 5A:
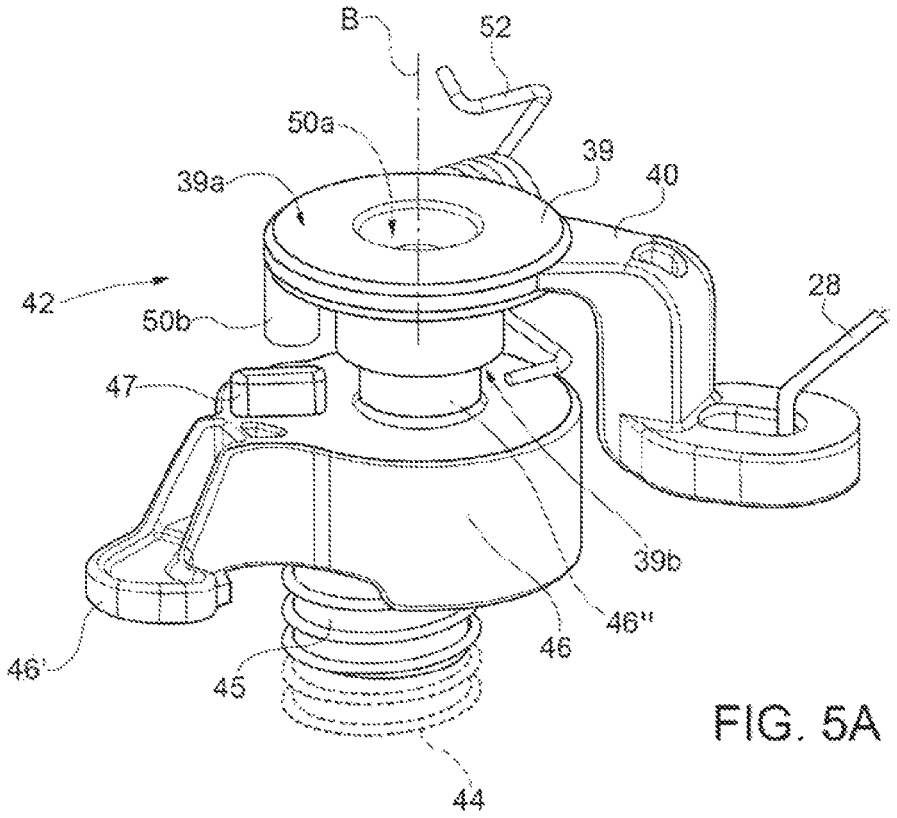
FIGS. 5*a*-5*b* show an embodiment of a coupling mechanism associated with the latch release backup system of the present disclosure in two different operating conditions.
Figure 5B:
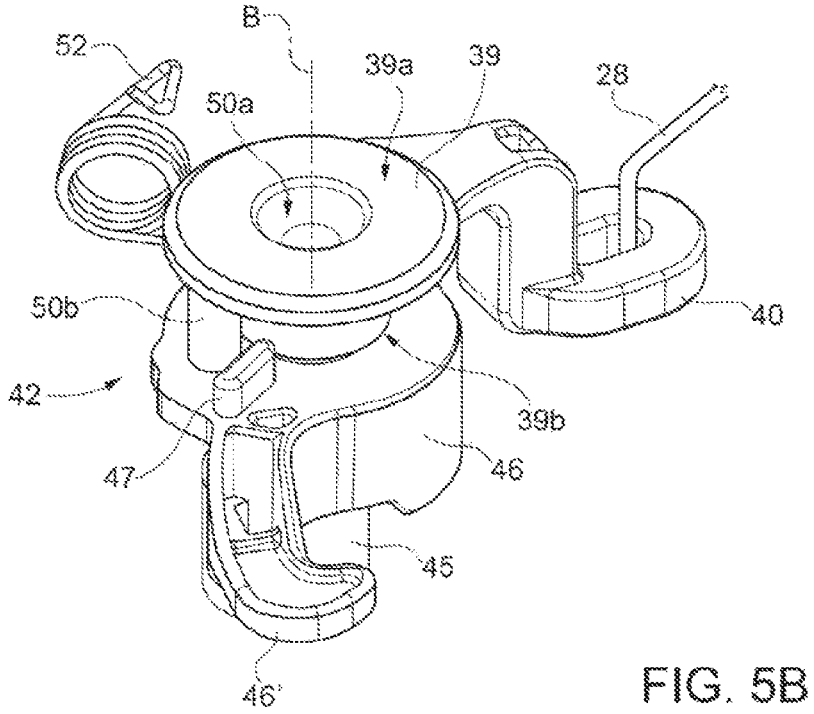

In more details and with particular reference to FIGS. 5*a* and 5*b*, actuation unit 38 further includes a coupling device 42 that is housed within case 31 (here not shown) and operable, in particular under control of the actuation control signal Sc generated by control unit 33, to cause engagement between external lever 40 and the actuation group 6' of the latching mechanism.

In a possible embodiment, shown in the FIGS. 5*a* and 5*b*, coupling device 42 includes a solenoid 44 which receives and is excited by the actuation control signal Sc, and a magnetic element 45 coupled to solenoid 44 and which moves, due to the generated magnetic field, along a direction parallel to the longitudinal axis B.

A coupling body 46 is integrally coupled to magnetic element 45 and carries, at a top surface thereof (with respect to the same longitudinal axis B) and facing second body portion 39*b* of main body 39 of actuator 38, a lug element 47. In addition, an internal lever 46' is integrally coupled to coupling body 46.

As shown in FIG. 5*a*, in the first (or disengaged) operating condition, when no magnetic field (no actuation control signal Sc) is generated by solenoid 44, magnetic element 45 and coupling body 46 are arranged at a distance from second body portion 39*b* of main body 39 of actuation unit 38. In this first operating condition, lug element 47 on coupling body 46 is displaced from engagement with a protruding drive element 50*b* extending from second body portion 39*b* of main body 39. As such, rotation of external lever 40 does not cause corresponding rotation of internal lever 46'.

As shown in FIG. 5*b*, in the second (or engaged) operating condition, when the actuation control signal Sc drives solenoid 44, magnetic element 45 moves due to the generated magnetic field and carries, along its movement, coupling body 46 towards second body portion 39*b*. Accordingly, lug element 47 of coupling body 46 abuts against protruding drive element 50*b* on second body portion 39*b* of main body 39 of actuator 38. Moreover, a protruding hub portion 46" of coupling body 46 enters into a seat 50*a* provided within second body portion 39*b*.

In this second operating condition, coupling body 46 is therefore mechanically coupled to main body 39 of actuator unit 38, whereby rotation of external lever 40 caused by its connection to arm segment 26 via connecting element 28 is therefore transmitted to coupling body 46. The consequent rotation of coupling body 46 is then transmitted to internal lever 46' and, thereby, to actuation group 6' of latch assembly 22 for causing release or unlocking thereof (any suitable mechanical coupling may be envisaged for the purpose, as will be clear for a person skilled in the field, between internal lever 46' and actuation group 6').

Coupling device 42 moreover includes an elastic element, such as a spring 52, operatively coupled to coupling body 46 and acting as a mechanical return element, as schematically shown in FIGS. 5*a*-5*b*.

It is understood that other solutions may be envisaged to selectively cause the releasable mechanical interconnection between actuation group 6' of latch assembly 22 and external lever 40. These alternatives may include, without limitations, arrangements using a micro-motor, or any other low power actuator driven by the control signal Sc generated by control unit 33, and therefore exploiting the energy coming from vehicle key 25 (again, as will be clear for a person skilled in the field).

Engagement between actuator 38 and actuation group 6' in latch assembly 22 is temporary (has a limited duration), suitable for release or unlocking of the latch. Afterwards, the latch can be reset or re-locked mechanically by any conventional means. For example, electronic key 25 being taken out from electrical interface socket (or receptacle) 24 causes interruption of the electrical power supply, and elastic element 52 may return the system in the disengaged state.

The advantages of the discussed solution are clear from the foregoing description.

In any case, it is underlined that latch release backup system 20 of the present disclosure provides the required release/unlocking functions for the user of the vehicle, while allowing elimination of the conventional mechanical key cylinder and latch release mechanical system.

The proposed electronic key and key cylinder arrangement not only allows simplification of the system and reduction of the weight, size and costs, but it also improves security and anti-theft features of the latch system, since the mechanical mechanisms for the release of the latch are not easily accessible, e.g. being arranged within vehicle door 18 and particularly within case 31 of latch assembly 22.

Moreover, the use of an electronic key cylinder allows standardization between vehicles and manufacturers, and in general provides a simplification in the management of vehicle access (e.g. in a vehicle fleet); in particular, programming of vehicle key 25 may require only storing a proper identification code (or information associated thereto) in memory 29', to allow electronic identification and authentication of the key and consequent release of the latch.

Clearly, changes may be made to what is described and illustrated herein without, however, departing from the scope defined in the accompanying claims. For example, it is underlined that control unit 33 of latch release backup system 20 may also be arranged within vehicle door 18, outside case 31 of latch assembly 22, particularly in case of an implementation with conventional mechanical latches.

Moreover, coupling device 42 could be arranged outside of case 31, possibly providing a selective engagement between external lever 40 of the actuator 28 and arm 26 of electronic key cylinder 21 (a fixed mechanical connection being in this case present within the latch between the same actuator 38 and actuation group 6'). Also in this case, engagement of the mechanical connection between movable arm 26 of electronic key cylinder 21 and the release of the latch is based on the processing of the identification and authorization code Id received from vehicle key 25 (or of any information associated thereto) by the electronic control unit 33. Moreover, the disclosed latch release backup system 20 may be used also in traditional latch assemblies, envisaging a purely mechanical release, or unlock, action on the latch. In particular, the proposed solution may also advantageously be used to upgrade any existing traditional latch assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A latch release system for a latch assembly of a motor-vehicle door, comprising:

a vehicle key having a power supply module for outputting a power supply signal (Vs) and a memory for storing identification information (Id);

a key cylinder mounted to the motor-vehicle door and defining an electrical interface socket configured to receive said vehicle key; and an electronic control unit electrically connected to the latch assembly and said electrical interface socket to communicate with said vehicle key to receive the power supply signal (Vs) from the power supply module of said vehicle key and the identification information (Id) stored in said memory of said vehicle key through said electrical interface socket in response to said vehicle key being plugged into said electrical interface socket and said electronic control unit operable to cause latch release using energy of the power supply signal (Vs) from said vehicle key upon authentication of the identification information (Id) received from said vehicle key.

2. The latch release system as set forth in claim 1, wherein said electrical interface socket includes a power supply pin designed to receive the power supply signal (Vs).

3. The latch release system as set forth in claim 2, wherein said electrical interface socket further includes a ground reference pin designed to be coupled to a reference voltage ground.

4. The latch release system as set forth in claim 2, wherein the identification information (Id) stored in said memory of said vehicle key is transmitted through said electrical interface socket electrical interface socket in the form of a coded data signal (Sd) transmitted through said power supply pin in addition to the power supply signal (Vs).

5. The latch release system as set forth in claim 2, wherein said electrical interface socket includes a data pin and the identification information (Id) stored in said memory of said vehicle key is transmitted through said electrical interface socket electrical interface socket in the form of a coded data signal (Sd) through said data pin.

6. The latch release system as set forth in claim 5, wherein said vehicle key includes an output interface module coupled to said memory and operable to transmit the identification information (Id) through said data pin of said electrical interface plug and provide the power supply signal (Vs) to said key cylinder.

7. The latch release system as set forth in claim 1, wherein said communication between said electronic control unit and said vehicle key is bi-directional.

8. The latch release system as set forth in claim 1, wherein said electrical interface socket is a USB standard electrical interface.

9. The latch release system as set forth in claim 1, wherein said key cylinder and said vehicle key do not have any matching mechanical code.

10. A door latch system for a motor vehicle door, comprising:

a latch assembly having a latch mechanism operable in a latched mode to hold the motor vehicle door in a closed state and in an unlatched mode to release the motor vehicle door in an opened state;

a latch release mechanism for shifting the latch mechanism from the latched mode into the unlatched mode;

a latch release system including a vehicle key having an electric interface plug and a memory for storing identification information (Id);

said latch release system having a key cylinder mounted to the motor vehicle door and having an electrical interface socket configured to receive said electric interface plug of said vehicle key; and said latch release system including an electronic control unit electrically connected to said latch assembly and to said electric interface socket to receive the identification information (Id) from said vehicle key through said electrical interface socket in response to said vehicle key being plugged into said electrical interface socket and control said latch release mechanism upon authentication of the identification information (Id) received from said vehicle key.

11. The latch release system as set forth in claim 10, wherein said latch assembly and said key cylinder are mechanically isolated from one another.

12. The door latch system as set forth in claim 10, wherein said latch release mechanism of said latch assembly is purely mechanical.

13. The door latch system as set forth in claim 10, wherein said vehicle key further includes a power supply module for outputting a power supply signal (Vs) and said latch assembly is configured to receive the power supply signal (Vs) through said electrical interface socket in response to said vehicle key being plugged into said electrical interface socket and said electronic control unit operable to control said latch release mechanism using energy of the power supply signal (Vs) from said vehicle key upon authentication of the identification information (Id) received from said vehicle key.

14. A latch release system for a latch assembly of a motor-vehicle door, comprising:

a vehicle key configured to output a power supply signal (Vs) and identification information (Id);

a key cylinder configured to receive said vehicle key and said key cylinder being mounted to the motor-vehicle door and defining an electrical interface socket configured to receive said vehicle key;

an electronic control unit electrically connected to the latch assembly and said electrical interface socket to communicate with said vehicle key to receive the power supply signal (Vs) and the identification information (Id) stored in said vehicle key in response to said vehicle key being plugged into said electrical interface socket and said electronic control unit operable to generate a control signal (Sc) upon authentication of the identification information (Id) received from said vehicle key; and a low power actuator mechanically coupled to the latch assembly and electrically connected to said electronic control unit and driven by the control signal generated by said electronic control unit and exploiting energy of the power supply signal (Vs) coming from said vehicle key to cause latch release of the latch assembly.

15. The latch release system as set forth in claim 14, wherein said low power actuator is a micro-motor.

16. The latch release system as set forth in claim 14, wherein the latch assembly includes an actuation group and said low power actuator selectively causes a releasable interconnection between the actuation group of the latch assembly and said key cylinder.

17. The latch release system as set forth in claim 14, wherein said electronic control unit includes an input interface electrically coupled to said key cylinder and a processing module electrically coupled to said input interface and an output interface electrically coupled to said processing module and configured to generate said control signal (Sc) and said input interface and said processing module and said output interface are electrically powered by the power supply signal (Vs) from said key cylinder.

18. The latch release system as set forth in claim 14, wherein said electrical interface socket is a USB standard electrical interface.

19. The latch release system as set forth in claim 14, wherein said key cylinder and said vehicle key do not have any matching mechanical code.

20. The latch release system as set forth in claim 14, wherein said communication between said electronic control unit and said vehicle key is bi-directional.

* * * * *